US005613600A

United States Patent [19]

Yokoji et al.

[11] Patent Number: 5,613,600

[45] Date of Patent: Mar. 25, 1997

[54] ROTATIVELY-OPERATED ELECTRONIC COMPONENT WITH PUSH SWITCH

[75] Inventors: Shigeru Yokoji; Hiroshi Matsui, both of Osaka; Tamotsu Yamamoto, Ashiya; Kazuhiro Enokido, Yokohama; Yutaka Yamagishi, Tokyo, all of Japan

[73] Assignee: Matsushita Electric Industrial Co., Ltd., Osaka, Japan

[21] Appl. No.: 582,501

[22] Filed: Jan. 3, 1996

[30] Foreign Application Priority Data

Jan. 24, 1995 [JP] Japan ..... 7-008567

[51] Int. Cl.[6] ..... H01H 19/14

[52] U.S. Cl. ..... 200/564; 200/5 R; 200/336; 200/565; 200/570

[58] Field of Search ..... 200/5 R, 564, 200/566, 567, 336, 565, 570

[56] References Cited

U.S. PATENT DOCUMENTS

| | | | |
|---|---|---|---|
| 4,504,706 | 3/1985 | Watanabe et al. . | |
| 4,896,006 | 1/1990 | Dard et al. | 200/336 |
| 4,996,401 | 2/1991 | Park . | |
| 5,008,496 | 4/1991 | Yamazaki | 200/565 |
| 5,043,546 | 8/1991 | Krause . | |
| 5,063,276 | 11/1991 | Woodard . | |
| 5,079,741 | 1/1992 | Kimura | 200/336 |
| 5,145,059 | 9/1992 | Park . | |
| 5,180,050 | 1/1993 | Rada et al. . | |

*Primary Examiner*—David J. Walczak
*Attorney, Agent, or Firm*—Pollock, Vande Sande & Priddy

[57] ABSTRACT

A rotatively-operated electronic component with a push switch includes an attachment base plate. A rotatively-operated electronic component portion supported on the attachment base plate has a rotatable operation knob. An electric signal can be generated in response to rotation of the operation knob. The rotatively-operated electronic component portion can move relative to the attachment base plate by application of a force to the operation knob. A push switch portion is supported on the attachment base plate. The push switch portion is actuated in response to movement of the rotatively-operated electronic component portion relative to the attachment base plate by the application of the force to the operation knob.

5 Claims, 6 Drawing Sheets

ROTATIVELY-OPERATED ELECTRONIC COMPONENT WITH PUSH SWITCH

BACKGROUND OF THE INVENTION

1. Field of the Invention

This invention relates to a rotatively-operated electronic component with a push switch which is usable in various electronic devices such as a remote-controller operation unit or a portable electronic device.

2. Description of the Prior Art

It is known that a rotatively-operated electronic component and a push switch which have different knobs are separately provided in an electronic device. A typical example of the rotatively-operated electronic component is a rotary encoder having a knob which is rotatable about an axis perpendicular to a main plane of an encoder body. In the above-indicated known arrangement, the total space occupied by the two knobs tends to be relatively large. This causes a barrier to the miniaturization of the arrangement. To operate the electronic component and the push switch, it is necessary to actuate both the two knobs. This causes inconvenience.

SUMMARY OF THE INVENTION

It is an object of this invention to provide a small electronic component with a push switch.

It is another object of this invention to provide an easily-operated electronic component with a push switch.

A first aspect of this invention provides a rotatively-operated electronic component with a push switch which comprises an attachment base plate; a rotatively-operated electronic component portion supported on the attachment base plate and including a rotatable operation knob, and means for generating an electric signal in response to rotation of the operation knob: means for allowing the rotatively-operated electronic component portion to move relative to the attachment base plate by application of a force to the operation knob; a push switch portion supported on the attachment base plate; and means for actuating the push switch portion in response to movement of the rotatively-operated electronic component portion relative to the attachment base plate by the application of the force to the operation knob.

A second aspect of this invention is based on the first aspect thereof, and provides a rotatively-operated electronic component with a push switch which further comprises means for providing a resistance to rotation of the operation knob, the resistance-providing means including a rotary member rotatable together with the operation knob and having an uneven surface, a resilient member fixed to a casing of the rotatively-operated electronic component portion and having a projection in contact with the uneven surface of the rotary member.

A third aspect of this invention is based on the first aspect thereof, and provides a rotatively-operated electronic component with a push switch which further comprises a first resilient contact arm provided in the electric-signal generating means, and a second resilient contact arm for transmitting the electric signal from the rotatively-operated electronic component portion to a contact on the attachment base plate, the first resilient contact arm and the second resilient contact arm being formed by a common resilient metal plate.

A fourth aspect of this invention provides a composite device comprising a base member; an electronic component including a body and an operation knob rotatable relative to the body, wherein the electronic component is operated in response to rotation of the operation knob; means for supporting the electronic component on the base member; means for allowing the electronic component to move relative to the base member in response to application of a force to the operation knob; a push switch including an operation button engageable with a part of the body of the electronic component; means for supporting the push switch on the base member; and means for enabling the part of the body of the electronic component to actuate the operation button of the push switch in response to movement of the electronic component relative to the base member by the application of the force to the operation knob.

A fifth aspect of this invention provides a composite device comprising a base member; an electronic component including a body and an operation knob rotatable relative to the body, wherein the electronic component is operated in response to rotation of the operation knob; means for supporting the electronic component on the base member; means for allowing the electronic component to move relative to the base member in response to application of a force to the operation knob; a push switch including an operation button; means for supporting the push switch on the base member; and means for actuating the operation button of the push switch in response to movement of the electronic component relative to the base member by the application of the force to the operation knob.

DESCRIPTION OF THE PREFERRED EMBODIMENTS

First Embodiment

Regarding a first embodiment of this invention, a rotary encoder with a push switch will be described as an example of a rotatively-operated electronic component with a push switch.

Figure 1:
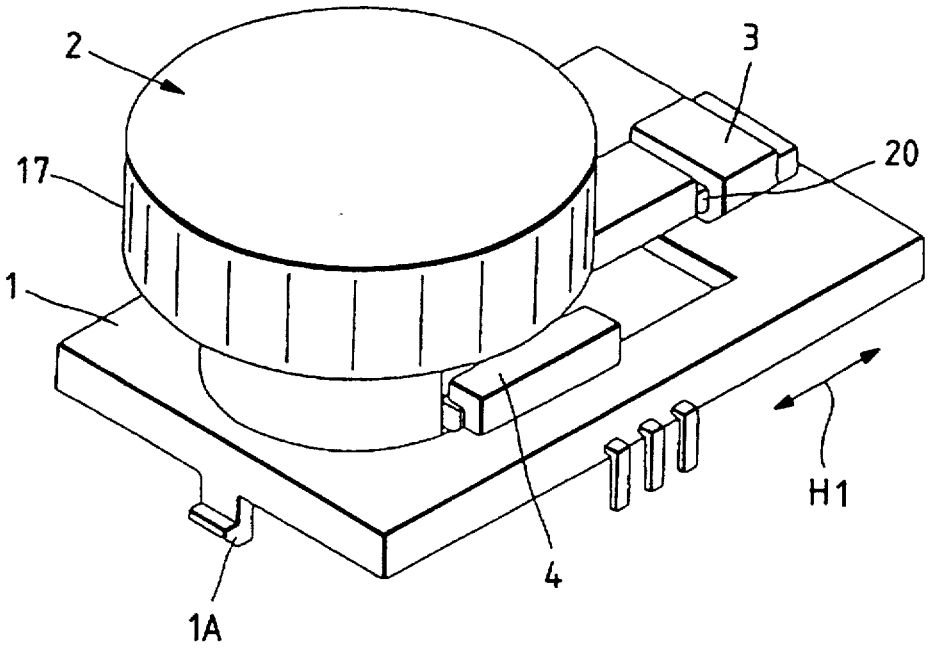
FIG. 1 is a perspective view of a rotary encoder with a push switch according to a first embodiment of this invention.

With reference to FIG. 1, a rotary encoder with a push switch includes an attachment base plate 1 provided with contacts. A rotary encoder portion 2 and a push switch portion 3 are provided on the attachment base plate 1. The rotary encoder portion 2 is movable relative to the attachment base plate 1 in a given range along a direction parallel to the attachment base plate 1. The push switch portion 3 has a body (a casing) fixed to the attachment base plate 1.

Figure 2:
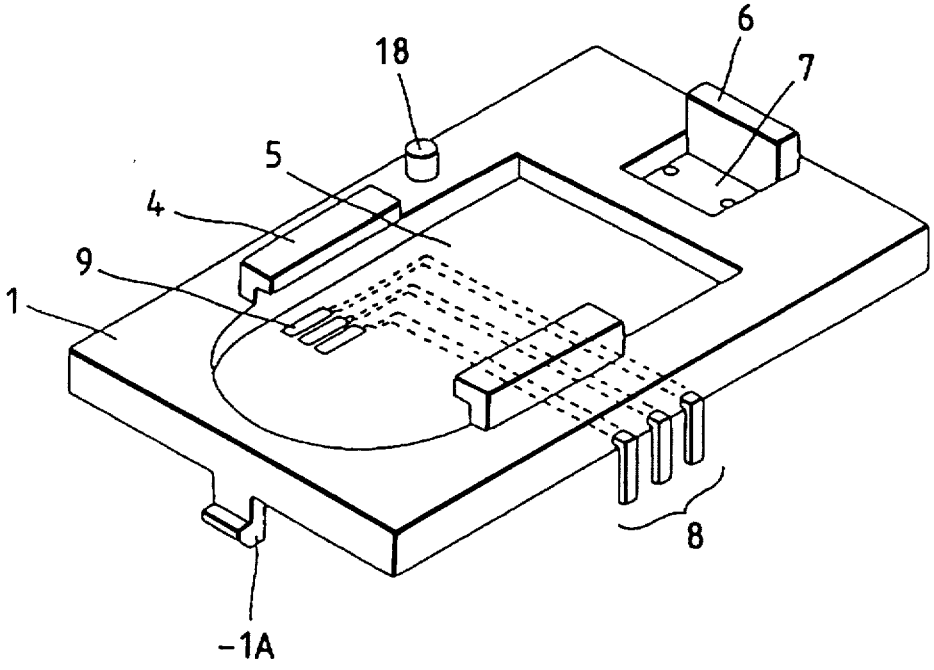
FIG. 2 is a perspective view of an attachment base plate in the rotary encoder with the push switch in FIG. 1.

With reference to FIG. 2, the attachment base plate 1 includes a molded resin member of approximately a flat plate shape which is provided with a recess 5, a recess 7, and contact plates 9. Guide rails 4 for motion of the rotary encoder portion 2 fixedly extend on the attachment base plate 1 along opposite side edges of the recess 5. A stop wall 6 fixedly extends on the attachment base plate 1 along a rear edge of the recess 7. The stop wall 6 serves to hold or fix the push switch portion 3. The contact plates 9 have connection terminals 8 for transmitting an electric signal from the rotary encoder portion 2 to an exterior.

Figure 3:
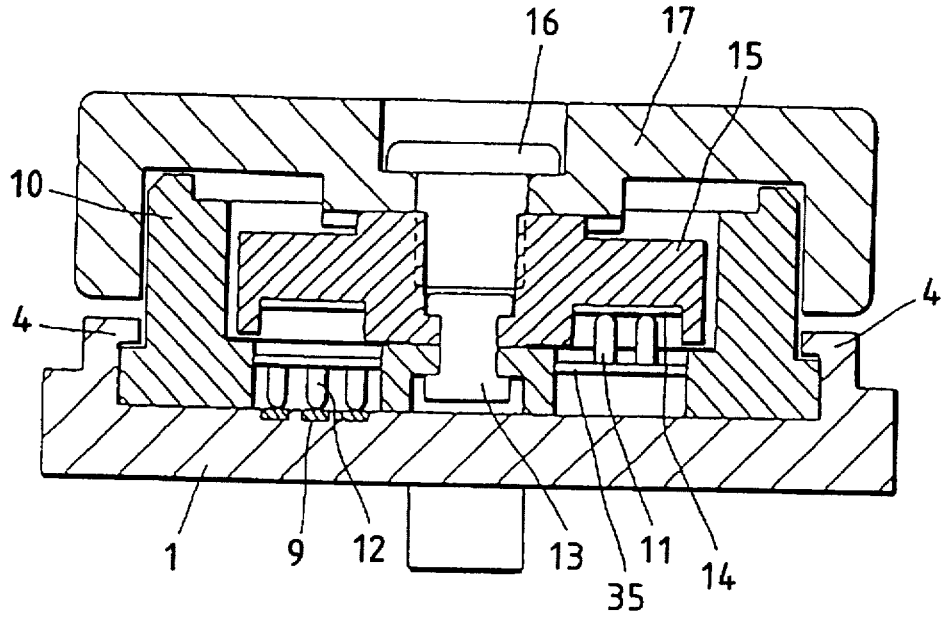
FIG. 3 is a first sectional view of the rotary encoder with the push switch in FIG. 1.
Figure 4:
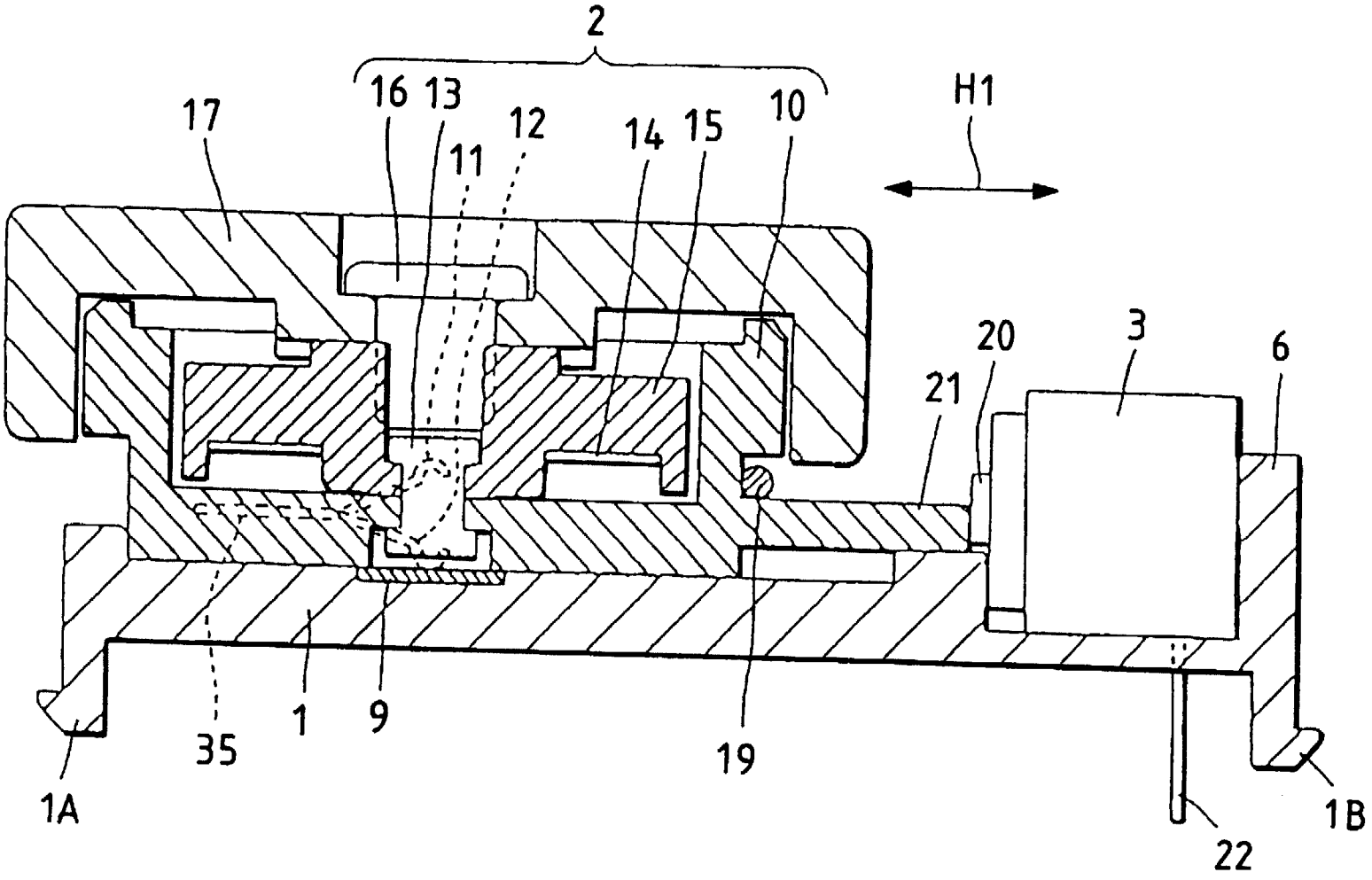
FIG. 4 is a second sectional view of the rotary encoder with the push switch in FIG. 1.

As shown in FIGS. 3 and 4, the rotary encoder portion 2 includes a box-shaped casing 10, resilient contact arms (flexible contact arms) 11 and 12, a rotary member 15, and a disk-shaped or cylinder-shaped operation knob 17. The box-shaped casing 10 fits into the recess 5 in the attachment base plate 1, and is movably or slidably held between the guide rails 4. The box-shaped casing 10 is movable relative to the attachment base plate 1 in a given range along opposite directions (opposite directions denoted by arrows H1 in FIGS. 1 and 4) parallel to the attachment base plate 4. The box-shaped casing 10 is made of molded resin. The resilient contact arms 11 extend from a contact member 35 along an upwardly sloping direction. On the other hand, the resilient contact arms 12 extend from the contact member 35 along a downwardly sloping direction. The resilient contact arms 11, the resilient contact arms 12, and the contact member 35 are integral with each other, and are made of suitable metal. The contact member 35 is attached to the bottom walls of the box-shaped casing 10 by a suitable way such as an insert molding process. The rotary member 15 is rotatably supported by a cylindrical shaft 13 integral with a central portion of the box-shaped casing 10. It should be noted that the cylindrical shaft 13 may be a member separate from the box-shaped casing 10 and mounted thereon. The rotary member 15 has a disk shape. A lower surface of the rotary member 15 is provided with a contact plate 14 which can contact with the resilient contact arms 11. The contact plate 14 has contact segments which are regularly arranged at equal intervals along a circumferential direction of the rotary member 15 (see FIG. 6). The rotary member 15 is made of molded resin. The disk-shaped operation knob 17 is attached to an upper portion of the rotary member 15 by a screw 16. The cylindrical shaft 13, the rotary member 15, and the disk-shaped operation knob 17 are coaxial with each other. The rotary member 15 rotates as the disk-shaped operation knob 17 rotates. The disk-shaped operation knob 17 is designed so that it can be operated by touching outer cylindrical surfaces (outer circumferential surfaces) thereof.

Figure 6:
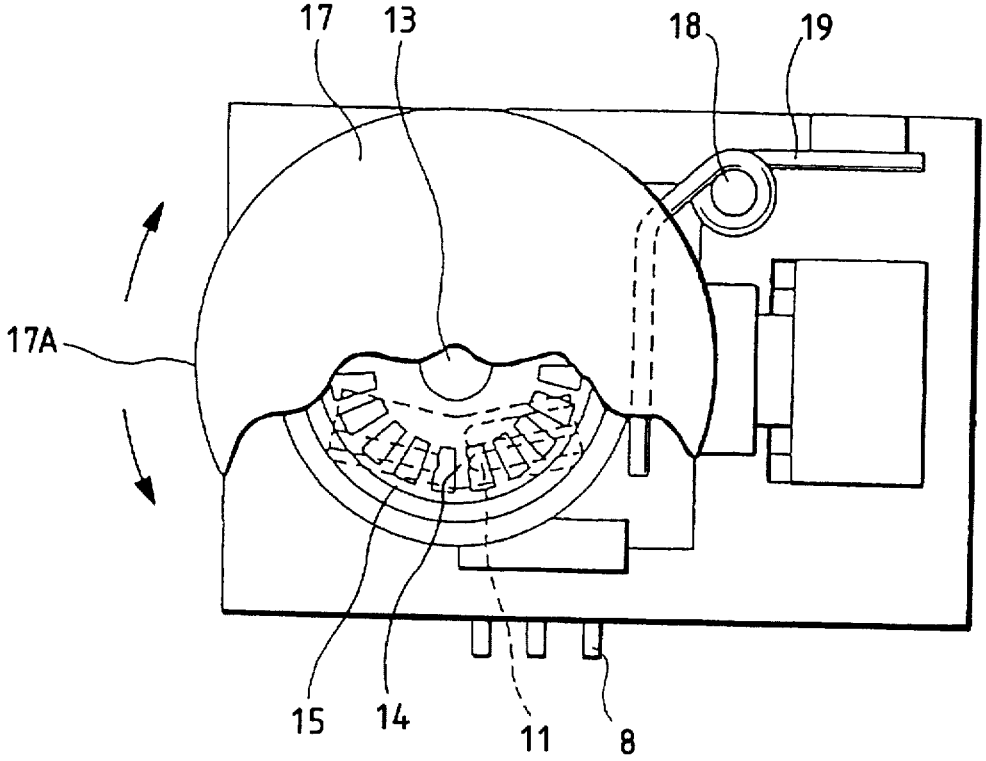
FIG. 6 is a top view, with a portion broken away, of the rotary encoder with the push switch in FIG. 1.

The attachment base plate 1 has a pin-shaped upward projection 18 which supports a torsion coil spring 19 (see FIG. 6). The torsion coil spring 19 urges a side surface of the box-shaped casing 10 relative to the pin-shaped upward projection 18 (that is, relative to the attachment base plate 1) in a direction parallel to the attachment base plate 1. Normally, the torsion coil spring 19 holds the box-shaped casing 10 in a position remote from the push switch portion 3 while the resilient contact arms 12, which project downward from a lower surface of the box-shaped casing 10, are in contact with the contact plates 9 on the attachment base plate 1.

As shown in FIG. 4, the push switch portion 3 fits into the recess 7 in the attachment base plate 1. A rear end of the push switch portion 3 contacts with the stop wall 6. Thereby, the body (the casing) of the push switch portion 3 is fixed to the attachment base plate 1. The push switch portion 3 has an operation button 20 which faces the rotary encoder portion 2. A drive projection 21 integral with the box-shaped casing 10 of the rotary encoder portion 2 contacts with a front end of the operation button 20 of the push switch portion 3.

Figure 5:
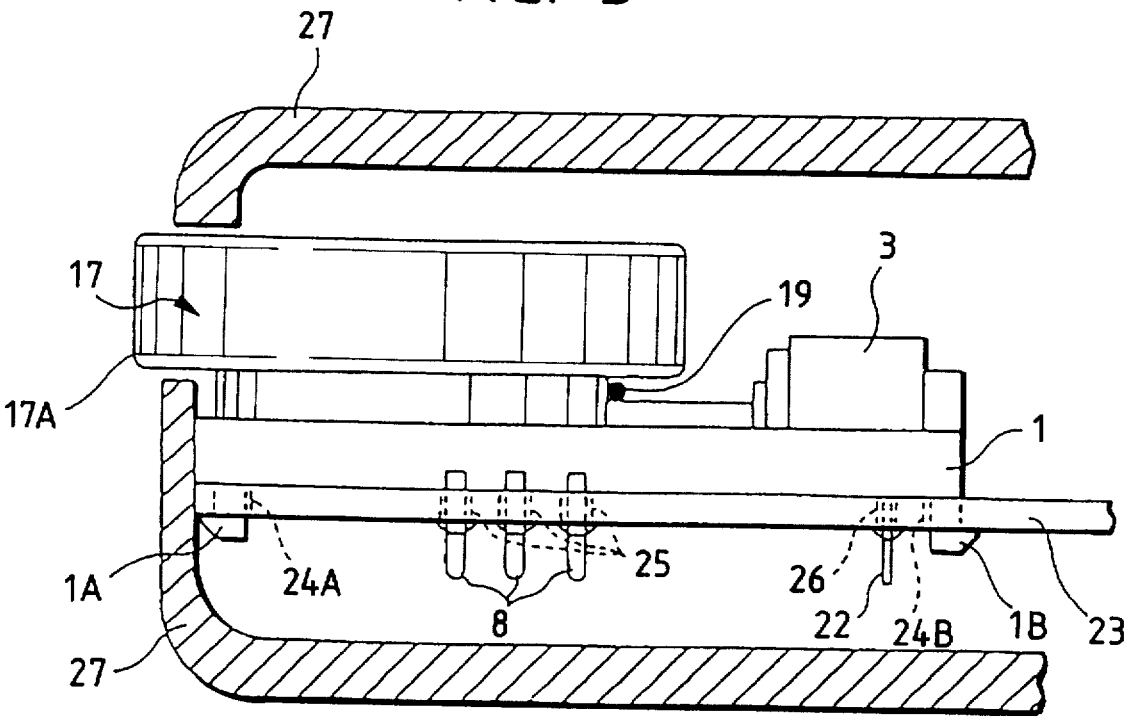
FIG. 5 is a sectional view of an electronic device and the rotary encoder with the push switch in FIG. 1.

FIG. 5 shows an example of conditions where the rotary encoder with the push switch is mounted on an electronic device. With reference to FIG. 5, downwardly-projecting legs 1A and 1B on the attachment base plate 1 are passed through attachment holes 24A and 24B in a printed wiring board 23 respectively. The connection terminals 8 of the rotary encoder portion 2 are passed through attachment holes 25 in the printed wiring board 23, being soldered to wiring areas on the printed wiring board 23 respectively. Connection terminals 22 of the push switch portion 3 are passed through attachment holes 26 in the printed wiring board 23, being soldered to wiring areas on the printed wiring board 23 respectively. An edge part or an outer part 17A of the disk-shaped operation knob 17 of the rotary encoder portion 2, which is remote from the push switch portion 3, emerges from a housing 27 of the electronic device via an opening therein. Thus, access to the disk-shaped knob is enabled.

Hereinafter, a description will be given of operation of the rotary encoder with the push switch. With reference to FIGS. 5 and 6, the edge part 17A of the disk-shaped operation knob 17 projects outwardly from the housing 27 of the electronic device. The disk-shaped operation knob 17 of the rotary encoder portion 2 can be rotated about the cylindrical shaft 13 at the center of the box-shaped casing 10 by applying a force to the projecting part 17A thereof along a tangential direction. During rotation of the disk-shaped operation knob 17, at least one of the upwardly-projecting resilient contact arms 11 sequentially moves into and out of touch with the contact segments of the contact plate 14 on the lower surface of the box-shaped casing 10 so that an electric pulse signal can be generated. The generated pulse signal depends on the rotation of the disk-shaped operation knob 17.

The pulse signal travels from the upwardly-projecting resilient contact arms 11 to the downwardly-projecting resilient contact arms 12 via the contact member 35 before reaching the contact plates 9 on the attachment base plate 1 which are in contact with the resilient contact arms 12. The pulse signal travels from the contact plates 9 to an electronic circuit on the printed wiring board 23 of the electronic device via the connection terminals 8.

Figure 7:
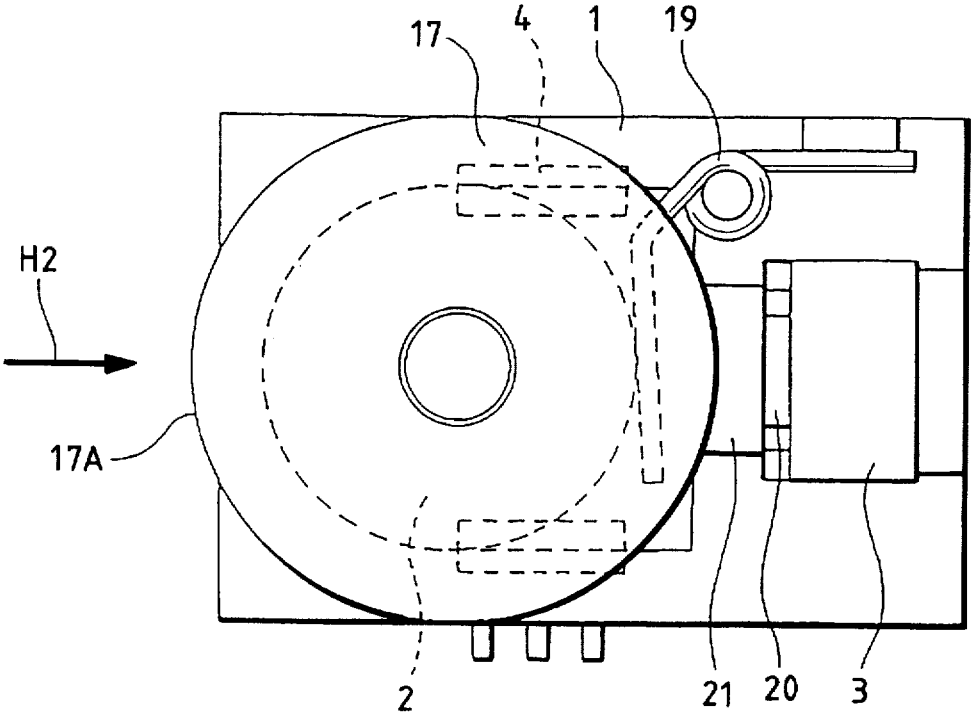
FIG. 7 is another top view of the rotary encoder with the push switch in FIG. 1.

With reference to FIGS. 5 and 7, in the case where the projecting part 17A of the disk-shaped operation knob 17 of the rotary encoder portion 2 is depressed relative to the housing 27 of the electronic device along a direction H2 parallel to the attachment base plate 1 (that is, a direction of the line connecting the center of the knob 17 and the center of the push switch portion 3), the whole of the rotary encoder portion 2 can be moved along the guide rails 4 on the attachment base plate 1 against the force of the torsion coil spring 19 on the attachment base plate 1. The drive projection 21 on the box-shaped casing 10 moves together with the rotary encoder portion 2, depressing and actuating the operation button 20 of the push switch portion 3. An electric signal can be generated in response to the actuation of the operation button 20 of the push switch portion 3. The electric signal is transmitted from the push switch portion 3 to the circuit on the printed wiring board 23 of the electronic device via the connection terminals 22. When the depressing force is removed from the disk-shaped operation knob 17, the rotary encoder portion 2 is returned to its normal position (see FIG. 6) by the force of the torsion coil spring 19 on the attachment base plate 1.

As understood from the previous description, means for transmitting an electric signal from the rotary encoder portion 2 to the connection terminals 8 on the attachment base plate 1 includes the resilient contact arms 12 which project downwardly from the lower surface of the box-shaped casing 10 and which are in contact with the contact plates 9 on the attachment base plate 1. This arrangement may be replaced by the following design. Contact plates are provided on a lower surface of the box-shaped casing 10 while resilient contact arms in contact with the contact plates are provided on the attachment base plate 1.

The rotary encoder portion 2 may be replaced by another rotatively-operated electronic component such as a rotary variable resistor.

The rotary encoder with the push switch has advantages as follows. The rotary encoder portion 2 is operated by actuating the disk-shaped operation knob 17. Also, the push switch portion 3 is operated by actuating the disk-shaped operation knob 17. Accordingly, the operation button 20 of the push switch portion 3 can be small. This enables a small size of the rotary encoder with the push switch. As previously described, the rotary encoder portion 2 and the push switch portion 3 are operated by actuating only the disk-shaped operation knob 17. Thus, the rotary encoder with the push switch can be easily and quickly operated. The rotary encoder portion 2 and the push switch portion 3 are provided in common on the attachment base plate 1. Therefore, the rotary encoder with the push switch can be handled as a single unit or a single electronic component. Furthermore, the positional relation between the rotary encoder portion 2 and the push switch portion 3 can be accurately maintained. In addition, the rotary encoder with the push switch can be easily attached to an electronic device.

Second Embodiment

Figure 8:
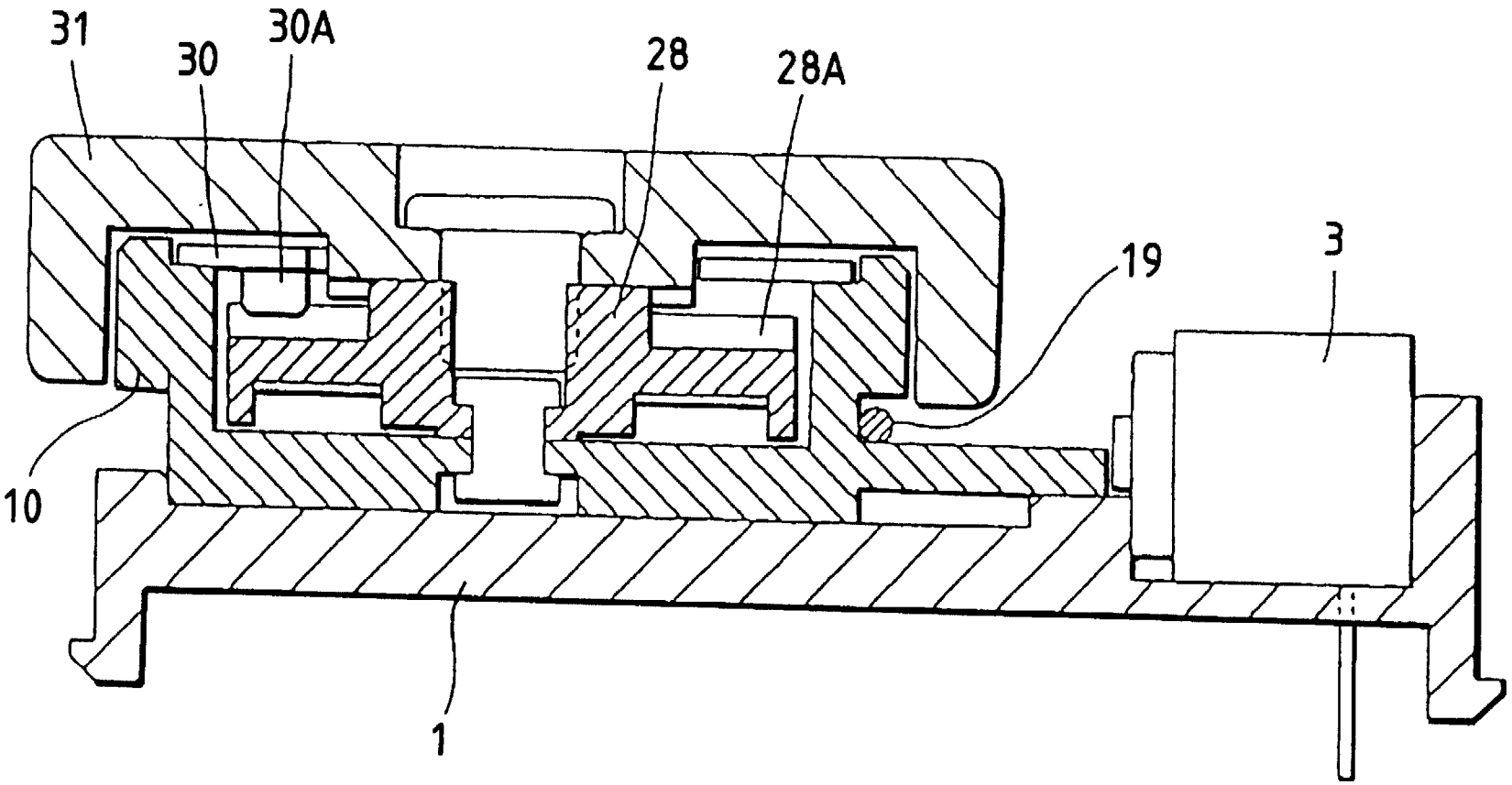
FIG. 8 is a sectional view of a rotary encoder with a push switch according to a second embodiment of this invention.

FIG. 8 shows a second embodiment of this invention which is similar to the embodiment of FIGS. 1–7 except for design changes indicated hereinafter.

Figure 9:
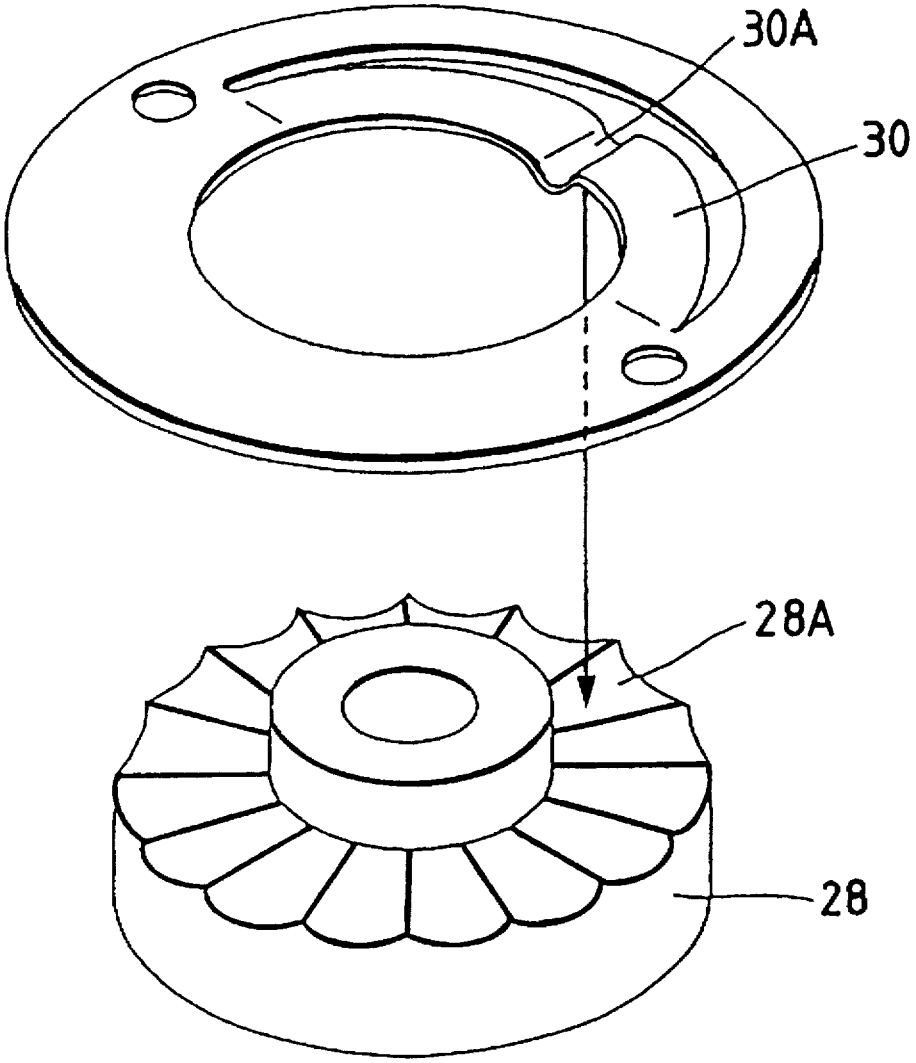
FIG. 9 is a perspective exploded view of a rotary member and a disk member in the rotary encoder with the push switch in FIG. 8.

The embodiment of FIG. 8 includes a rotary member 28 corresponding to the rotary member 15 of FIG. 3. As shown in FIG. 9, the rotary member 28 has an uneven upper surface 28A formed with projections and recesses extending radially. The embodiment of FIG. 8 includes a disk member 30 fixed to a box-shaped casing 10. As shown in FIG. 9, the disk member 30 has a circumferentially-extending resilient portion formed with a downward projection 30A. The downward projection 30A on the disk member 30 engages the upper surface 28A of the rotary member 28.

The embodiment of FIG. 8 includes a disk-shaped operation knob 31 corresponding to the disk-shaped operation knob 17 of FIG. 3. During rotation of the disk-shaped operation knob 31, the downward projection 30A on the disk member 30 relatively rotates and slides on the upper surface 28A of the rotary member 28 while following the unevenness in the upper surface 28A of the rotary member 28. In this case, the contact between the downward projection 30A on the disk member 30 and the uneven upper surface 28A of the rotary member 28 provides a suitable resistance to the rotation of the rotary member 28, that is, the rotation of the disk-shaped operation knob 31. Furthermore, during an action of pressing the disk-shaped operation knob 31 to actuate a push switch portion 3, the contact between the downward projection 30A on the disk member 30 and the uneven upper surface 28A of the rotary member 28 prevents the disk-shaped operation knob 31 from being erroneously rotated.

What is claimed is:

1. A rotatively-operated electronic component with a push switch, comprising:

an attachment base plate;

a rotatively-operated electronic component portion supported on said attachment base plate and including a rotatable operation knob which is rotatable about an axis, and means for generating an electric signal in response to rotation of said operation knob;

means for allowing said rotatively-operated electronic component portion to laterally and substantially perpendicular to said axis plate by application of a lateral force to said operation knob;

a push switch portion supported on said attachment base plate; and means for actuating said push switch portion in response to lateral movement of said rotatively-operated electronic component portion relative to said attachment base plate by said application of said force to said operation knob.

2. A rotatively-operated electronic component with a push switch as recited in claim 1, further comprising means for providing a resistance to rotation of said operation knob, said resistance-providing means including a rotary member rotatable together with said operation knob and having an uneven surface, a resilient member fixed to a casing of said rotatively-operated electronic component portion and having a projection in contact with said uneven surface of said rotary member.

3. A rotatively-operated electronic component with a push switch as recited in claim 1, further comprising a first resilient contact arm provided in said electric-signal generating means, and a second resilient contact arm for transmitting said electric signal from said rotatively-operated electronic component portion to a contact on said attachment base plate, said first resilient contact arm and said second resilient contact arm being formed by a common resilient metal plate.

4. A composite device comprising:

a base member;

an electronic component including a body and an operation knob rotatable about an axis relative to said body, wherein said electronic component is operated in response to rotation of said operation knob;

means for supporting said electronic component on said base member;

means for allowing said electronic component to laterally and substantially perpendicular to said axis in response to application of a lateral force to said operation knob;

a push switch including an operation button engageable with a part of said body of said electronic component;

means for supporting said push switch on said base member; and means for enabling said part of said body of said electronic component to actuate said operation button of said push switch in response to lateral movement of said electronic component relative to said base member by said application of said force to said operation knob.

5. A composite device comprising:

a base member;

an electronic component including a body and an operation knob rotatable about an axis relative to said body, wherein said electronic component is operated in response to rotation of said operation knob;

means for supporting said electronic component on said base member;

means for allowing said electronic component to move laterally relative to said base member and substantially perpendicular to said axis in response to application of a force to said operation knob;

a push switch including an operation button;

means for supporting said push switch on said base member; and means for actuating said operation button of said push switch in response to lateral movement of said electronic component relative to said base member by said application of said force to said operation knob.

* * * * *

UNITED STATES PATENT AND TRADEMARK OFFICE

CERTIFICATE OF CORRECTION

PATENT NO. : 5,613,600
DATED : March 25, 1997
INVENTOR(S) : Shigeru Yokoji et al.

It is certified that error appears in the above-indentified patent and that said Letters Patent is hereby corrected as shown below:

Title page, line [73], the second Assignee has been omitted. After "Matsushita Electric Industrial Co., Ltd., Osaka, Japan", insert --Sony Corporation, Tokyo, Japan--.

Signed and Sealed this

Second Day of September, 1997

*Attest:*

Bruce Lehman

BRUCE LEHMAN

*Attesting Officer*

*Commissioner of Patents and Trademarks*